US006039432A

United States Patent [19]

Fukuoka

[11] Patent Number: 6,039,432

[45] Date of Patent: Mar. 21, 2000

[54] INK JET RECORDING APPARATUS WITH RECOVERING DEVICE OF INK JET HEAD

[75] Inventor: Mutsuo Fukuoka, Ama-gun, Japan

[73] Assignee: Brother Kogyo Kabushiki Kaisha, Nagoya, Japan

[21] Appl. No.: 08/695,633

[22] Filed: Aug. 12, 1996

[30] Foreign Application Priority Data

Aug. 24, 1995 [JP] Japan ..... 7-240708

[51] Int. Cl.[7] ..... B41J 2/165

[52] U.S. Cl. ..... 347/32; 347/30

[58] Field of Search ..... 347/29, 30, 32, 347/23

[56] References Cited

U.S. PATENT DOCUMENTS

| | | | |
|---|---|---|---|
| 5,126,764 | 6/1992 | Miyauchi et al. | 347/30 |
| 5,138,334 | 8/1992 | Rowe et al. | 347/30 |
| 5,325,111 | 6/1994 | Dietl | 347/30 |
| 5,416,507 | 5/1995 | Otsuka | 347/30 |
| 5,483,266 | 1/1996 | Nakamura | 347/30 |

FOREIGN PATENT DOCUMENTS 6-126947 5/1994 Japan .

*Primary Examiner*—N. Le
*Assistant Examiner*—Thien Tran
*Attorney, Agent, or Firm*—Oliff & Berridge, PLC

[57] ABSTRACT

An ink jet printer having an ink jet head, a cap covering the ink jet head, and a suction pump for recovering the ink jetting condition of the ink jet head by adding negative pressure to the cap and sucking the inferior ink from the ink jet head. A coil spring forces the cap to contact the ink jet head while rail members having a cam groove control the contact force between the cap and the ink jet head. The contact force is controlled in at least two continuous stages. In the first stage, a first suction operation is conducted while the cap and ink jet head are contacting each other under a contact force having a first strength where a space formed between the cap and ink jet head does not communicate with the atmosphere. The second suction operation is performed after the first suction operation while the cap and ink jet head are partially contacting each other under a contact force having a second strength different from the first strength where the space is partially communicating with the atmosphere.

23 Claims, 13 Drawing Sheets

INK JET RECORDING APPARATUS WITH RECOVERING DEVICE OF INK JET HEAD

BACKGROUND OF THE INVENTION

1. Field of the Invention

The present invention relates to an ink jet recording apparatus with a recovering device for recovering poor ink jetting condition of an ink jet head into good ink jetting condition thereof. In particular, the present invention relates to an ink jet recording apparatus through which it can avoid that the ink shifted from the ink jet head to a cap installed in the recovering device is leaked from the cap while recovering operation.

2. Description of Related Art

In general, an ink jet recording apparatus is used for recording images, characters, figures, etc. on a recording medium such as a print sheet by ejecting ink droplets from an ink jet head. In this ink jet recording apparatus, it will occur in the ink jet head a condition where ink droplets cannot be ejected therefrom or where ink droplets cannot be correctly ejected therefrom. These conditions will occur due to that dust (which may be paper powders from the print sheet) adheres to a nozzle plane of the ink jet head, air bubbles are produced in the ink in the ink jet head by sucking of air from top face of the nozzle plane or viscosity of the ink in ink paths of the nozzles becomes high by evaporation of water in the ink.

Thus, there will be necessary recovering operation to improve the above inferior ink jetting conditions of the ink jet head to good ink jetting condition. As the recovering operation, in the conventional ink jet recording apparatus, following operation is generally conducted. That is, the nozzle plane of the ink jet head is covered by the cap when a carriage mounting the ink jet head comes to a predetermined position, and the dust on the nozzle plane or the inferior ink with air bubbles or high viscosity is sucked and removed by purge operation through which it is produced a negative pressure in the paths of the nozzles through the cap. This purge operation is divided into two stages. In the first stage, it is conducted a first suction operation (main suction operation) where the nozzle plane of the ink jet head is sucked under a state that the nozzle plane is completely sealed by the cap and the ink in the nozzles is sifted in the cap. And thereafter in the second stage, it is conducted a second suction operation (secondary suction operation) where the nozzle plane of the ink jet head is sucked under a state that a small gap is formed between the nozzle plane and the cap and the ink gathered in the cap is shifted to a drain tank.

It is disclosed in Japanese Patent Application, laid open No. Hei 6-126,947, an ink jet recording apparatus in which the purge operation similar to the above is conducted. In the disclosed ink jet recording apparatus, further the third suction operation is done after the second suction operation. That is, in such ink jet recording apparatus, the nozzle plane of the ink jet head is sucked while the second suction operation under a state that the nozzle plane and the cap are partially sealed and opened, and thereafter the nozzle plane is sucked while the third suction operation under a state that the nozzle plane and the cap are fully separated. Thereby, the ink gathered in the cap can be reliably removed therefrom without raising its cost.

However, in the above conventional ink jet recording apparatus, there is a problem that leak of the ink from the cap cannot be fully avoided while the secondary suction operation, as follows. In this ink jet recording apparatus, a suction pump is once stopped after the first suction operation and the negative pressure produced during the first suction operation varnishes. Thereafter, the cap is slightly separated from the ink jet head and both the cap and the ink jet head is held in the state that both are partially sealed and opened. Therefore, since the negative pressure of the suction pump does not act in the cap until the second suction operation is done by again operating the suction pump after the above state is realized, the ink is leaked from the gap formed between the nozzle plane and the cap. Further, the leaked ink is adhered onto the various parts of the ink jet recording apparatus and the recording medium, as a result, the inner parts of the apparatus and the recording medium becomes dirty by the leaked ink.

Here, in case that the cap is slightly separated from the ink jet head while the suction pump is held to operate after the first suction operation, air is instantaneously flowed in the cap that the negative pressure acts, thereby impact force occurs in the cap due to abrupt pressure change therein. Thus, it is necessary to avoid the above condition that the cap is separated from the ink jet head while the suction pump is held to operate. Concretely to say, meniscus (air-liquid interface) of the ink in the nozzles is destroyed and air is deeply enters in the ink jet head through the nozzles. In this case, the inferior ink jetting condition of the ink jet head is instead promoted more and more.

SUMMARY OF THE INVENTION

In order to overcome the above problems, the present invention provides an ink jet recording apparatus in which a first suction operation is conducted while a cap is pressed to an ink jet head by a first pressing force under which both the cap and the ink jet head are strongly pressed each other and a space formed between the cap and the ink jet head is not communicated with atmosphere when a negative pressure is added in the space by a suction means, and a second suction operation is conducted while the cap is pressed to the ink jet head by a second pressing force under which both the cap and the ink jet head are weakly pressed each other and the space is partially communicated with the atmosphere when the negative pressure is added in the space by the suction means. Thereby, it can avoid that the ink shifted from the ink jet head to the cap installed in the recovering device is leaked from the cap while recovering operation.

To accomplish the above object, the present invention provides an ink jet recording apparatus including an ink jet head for ejecting ink droplets from nozzles onto a recording medium, a cap for covering the ink jet head and suction means for sucking the ink and recovering ink jetting condition of the ink jet head by adding a negative pressure to the cap, the ink jet recording apparatus comprising:

pressing means for contacting the cap with the ink jet head and control means for controlling a contact force by the pressing means, through which the cap is contacted with the ink jet head, at least in two stages including a first stage and a second stage;

wherein the contact force corresponding to the first stage has a first strength that the cap is isolated from the atmosphere when the negative pressure is added to the cap by the suction means; and wherein the contact force corresponding to the second stage has a second strength that the cap is partially communicated with the atmosphere when the negative pressure is added to the cap by the suction means.

According to the present invention, the cap is strongly contacted with the ink jet head when the contact force by the pressing means is controlled to the first stage by the control means. In this state, the portion where the cap and the ink jet head contact each other is fully isolated from the atmosphere even if the negative pressure is added to the cap. Therefore, when the negative pressure is added under the above state, the negative pressure acts to the nozzles of the ink jet head and the ink is sucked form the ink jet head. Thereafter, the sucked ink is filled in the cap.

Further, the contact force corresponding to the second stage is weaker than the contact force corresponding to the first stage, that is, the first strength is smaller than the second strength when the the contact force by the pressing means is controlled to the second stage by the control means. In this state, the cap continues to contact with the ink jet head so long as the negative pressure is not added to the cap. But, if the negative pressure is added to the cap, the cap communicates with the atmosphere through the portion where the cap and the ink jet head contact each other. Therefore, even if the cap is released from the negative pressure by the suction means after the cap is filled up with the ink and the contact force is changed to the second stage from the first stage, the ink in the cap is not leaked therefrom. Further, when the negative pressure is added to the cap while the contact force of the second stage is maintained, not only the ink in the cap is sucked and removed but also the cap comes to communicate with the atmosphere at the portion where the cap and the ink jet head contact and air is introduced into the cap. Thus, the ink is not furthermore sucked from the ink jet head.

As mentioned above, according to the present invention, the control means controls the contact force, through which the cap is contacted with the ink jet head, at least in two stages including the first stage and the second stage, thereby both the contact force corresponding to the first stage under which the cap is isolated from the atmosphere even if the negative pressure is added to the cap by the suction means and the contact force corresponding to the second stage under which the cap is partially communicated with the atmosphere when the negative pressure is added to the cap, can be realized. Therefore, the ink filled in the cap can be certainly removed without leaking thereof by conducting the suction operation while the cap is hermetically contacted with the ink jet head under the contact force corresponding to the second stage.

As a result, it can be realized the ink jet recording apparatus that the ink sucked from the ink jet head can be certainly discharged without soiling the print sheet and the other mechanism in the apparatus.

The above and further objects and novel features of the invention will more fully appear from the following detailed description when the same is read in connection with the accompanying drawings. It is to be expressly understood, however, that the drawings are for purpose of illustration only and not intended as a definition of the limits of the invention.

BRIEF DESCRIPTION OF THE DRAWINGS

The ink jet recording apparatus according to the present invention will be described with reference to the following drawings wherein.

DETAILED DESCRIPTION OF THE PREFERRED EMBODIMENTS

Figure 1:
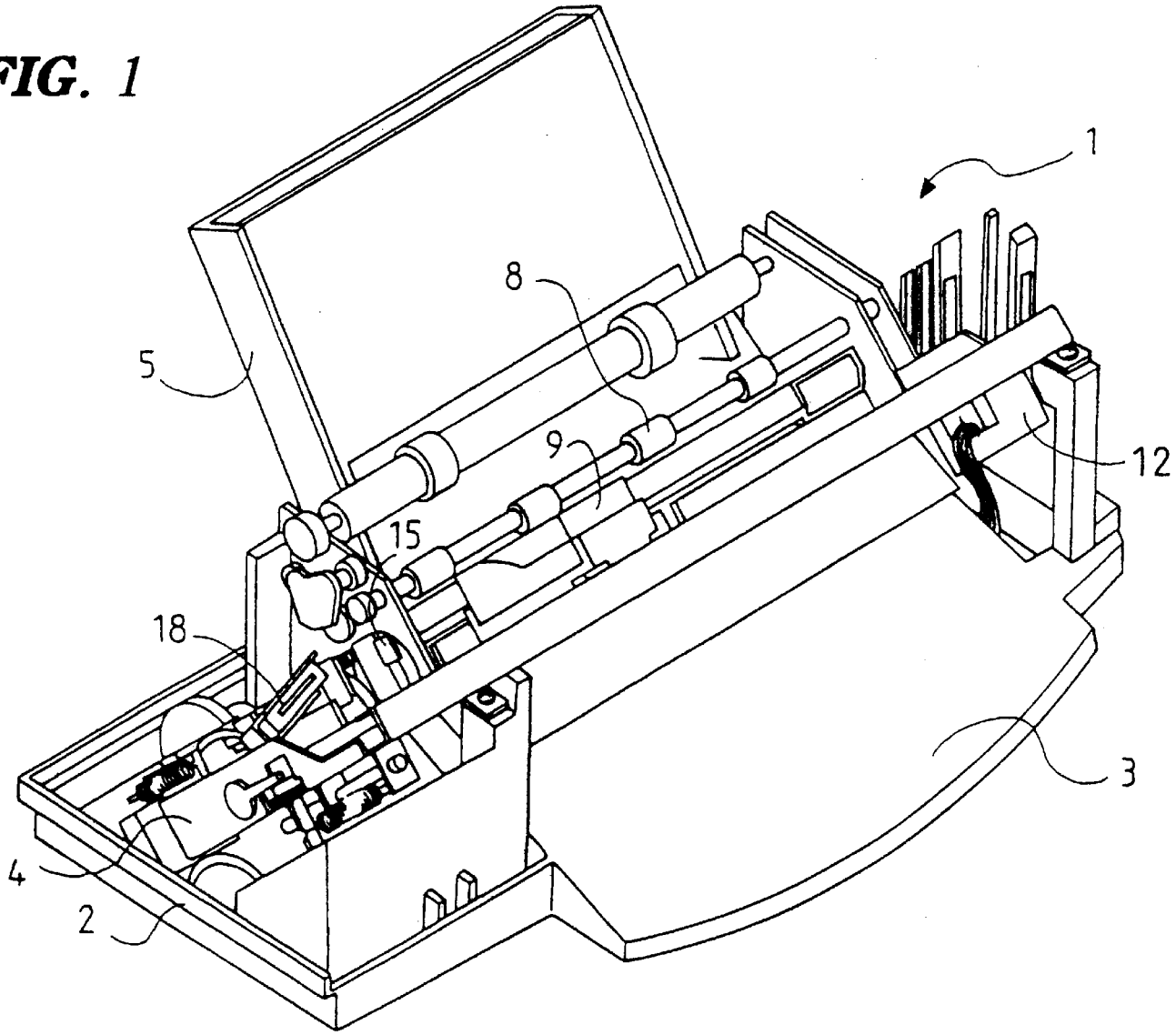
FIG. 1 is a perspective view showing an ink jet printer of the embodiment according to the present invention.

A detailed description of the preferred embodiments of the ink jet recording apparatus embodying the present invention will now be given with reference to the accompanying drawings.

At first, the ink jet printer according to the embodiment will be described. In the ink jet printer 1 shown in FIG. 1, it is arranged in front of a main frame 2 a manual sheet supply part 3 through which print sheets are manually supplied. At rear side of the manual sheet supply part 3, it is arranged at upper position of the main frame 2 a sub-frame 4 in which a carriage 9 having an ink jet head 10, a recovering mechanism RM and a sheet feeding mechanism LM are installed. At an upper rear position of the sub-frame 4, a sheet supply cassette 5 for stacking plural print sheets is releasably mounted.

Figure 2:
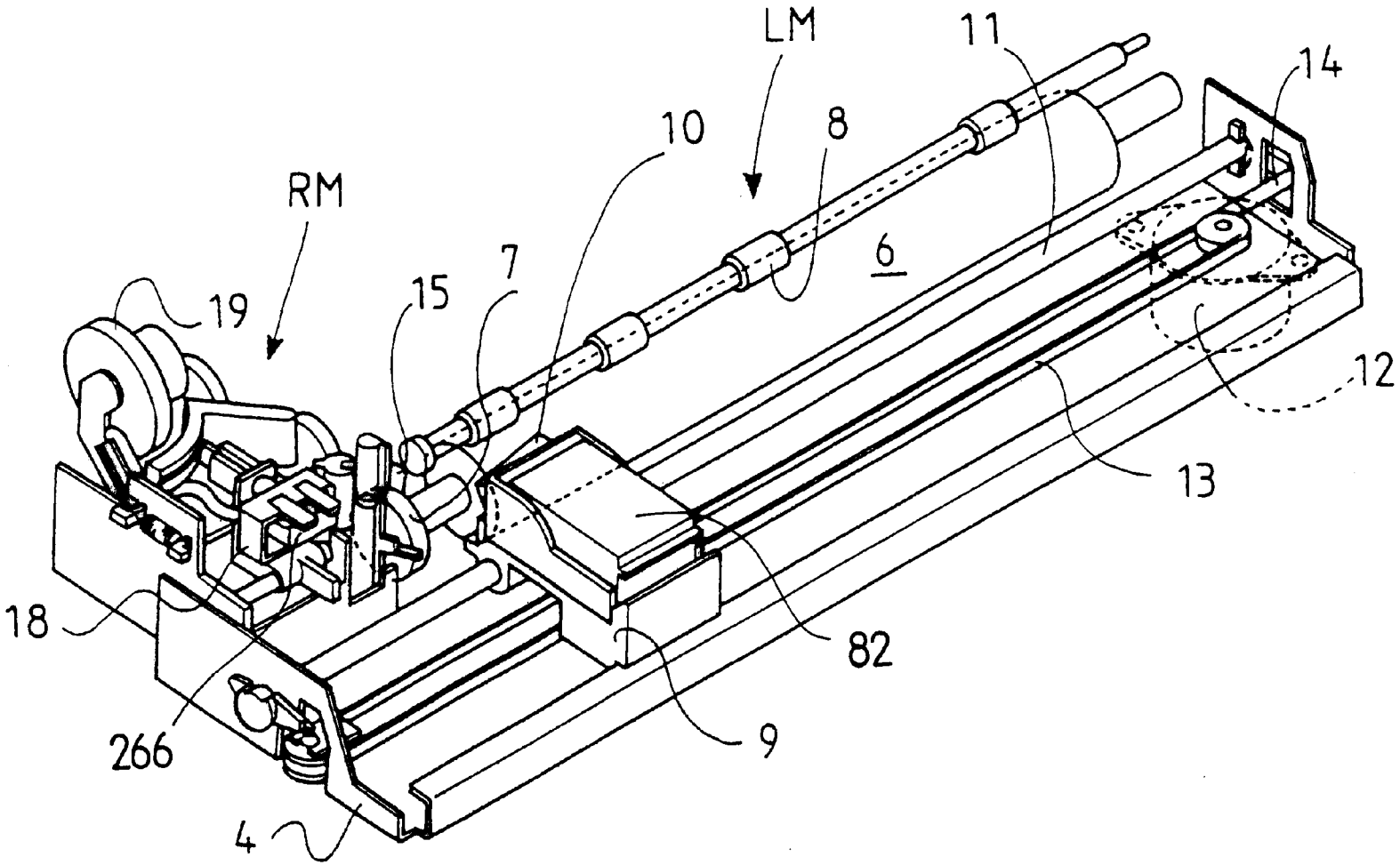
FIG. 2 is a perspective view showing a recovering mechanism and a sheet feeding mechanism in the ink jet printer.

The sub-frame 4 of the ink jet printer 1, the ink jet head 10, the recovering mechanism RM and the sheet feeding mechanism LM each of which are arranged in the sub-frame 4, are shown in FIG. 2. At the rear position in the sub-frame 4, a platen roller 6 which has a cylindrical shape is positioned. The platen roller 6 feeds the print sheet fed from the the sheet supply cassette 5 or the manual sheet supply part 3 while opposing to the ink jet head 10, thus the platen roller 6 constructs a part of the sheet feeding mechanism LM. On the upper side of the platen roller 6, a pressure roller 8 pressing the print sheet closely onto the platen roller 6 is arranged. Drive source of the platen roller 6 is a LF motor 29 (see FIG. 3) and a platen gear 7 exists between the platen roller 6 and the LF motor 29. Here, the platen gear 7 also acts for transmitting driving force to a sheet feed gear train (not shown) to feed one print sheet from the sheet supply cassette 5 to the platen roller 6.

At the front side of the platen roller 6, a carriage 9 is arranged. The carriage 9 releasably mounts thereon the ink jet head 10 and an ink cartridge 82 in which the ink supplied to the ink jet head 10 is filled, and is reciprocally movable along a carriage shaft 11 which is arranged parallel to the platen roller 6. Thereby, the ink jet head 10 can reciprocally move along the platen roller 6. At the right rear side of the sub-frame 4, a CR motor 12 driving the carriage 9 through a belt 13 is positioned. As the CR motor 12, it is utilizable a stepper motor or a DC motor. Along the belt 13, a position gauge 14 having a scale is arranged.

At the left side of the platen roller 6, the recovering mechanism RM for recovering the ink jet head 10 is arranged. The reason that the recovering mechanism RM is arranged is as follows. That is, there will occur that air bubbles are produced in the ink orifices of the nozzle plane in the ink jet head 10 while using thereof or the ink droplets are adhered on the nozzle plane. Due to this, it will occur ink jetting trouble that the ink droplets cannot be ejected or cannot be correctly ejected. Therefore, in this case, the recovering mechanism RM is used for recovering the ink jetting condition of the ink jet head 10 in a good state. In the recovering mechanism RM, a purge device 18 for sucking the inferior ink in the ink jet head 10 and a wiping device 15 for wiping the nozzle plane of the ink jet head 10 are arranged.

The purge device 18 has a well-known suction pump 356 (see FIG. 3) through which the negative pressure is produced and the inferior ink in the ink jet head 10 is sucked, thereby recovering operation of the ink jet head 10 is conducted. As drive source of the suction pump 356, it is utilized the LF motor 29, and a pump cam gear 19 exists between the suction pump 356 and the LF motor 29. At the top of the purge device 18, it is arranged a cap 266 for covering the nozzle plane of the ink jet head 10 when recovering operation is conducted.

Figure 4:
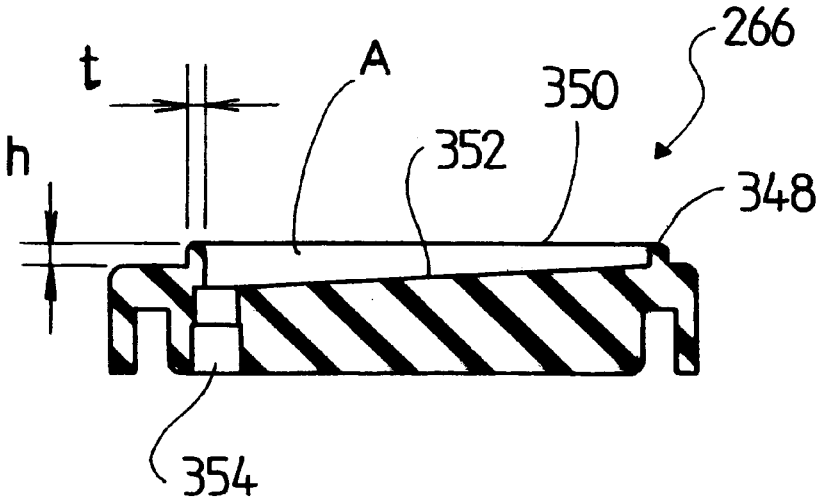
FIG. 4 is a sectional view of a cap utilized in the purge device.

As shown in FIG. 4, on the cap 266, there are formed a rib 348 for forming a space A when the cap 266 covers the nozzle plane of the ink jet head 10 and a hole 354 for introducing the negative pressure from the suction pump 356 into the space A and for being used as a discharging passage of the inferior ink. And the bottom plane 352 of the space A is inclined against a top face 350 of the rib 348 (which contacts with the ink jet head 10) and the hole 354 is formed at the deepest position thereof, as shown in FIG. 4.

Figure 5:
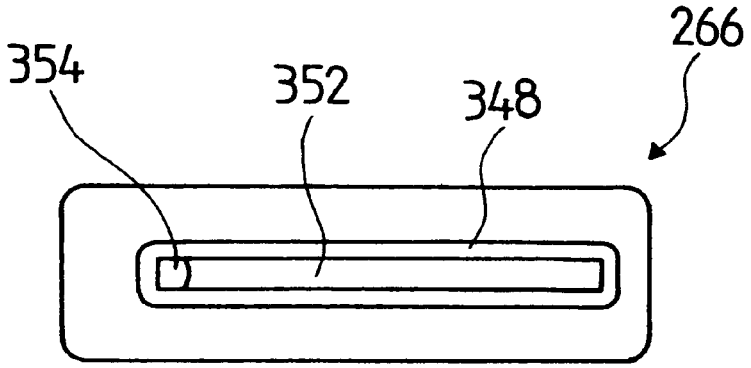
FIG. 5 is a plan view of the cap which indicates a shape of a rib formed on the cap.
Figure 6:
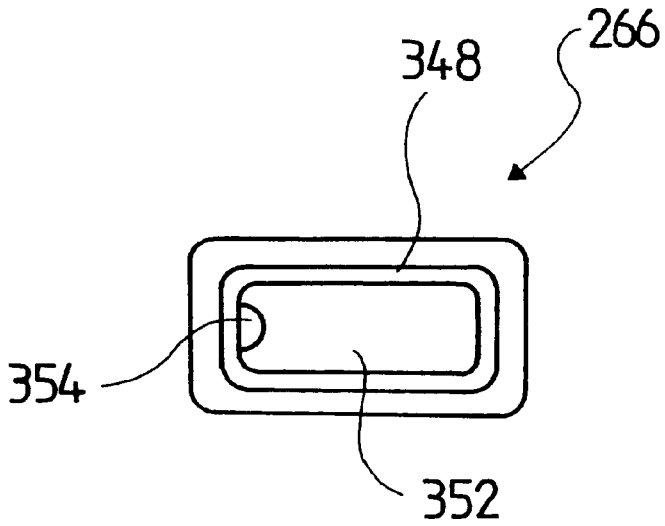
FIG. 6 is a plan view of the cap which indicates another shape of the rib.

The rib 348, as shown in FIGS. 5 and 6, has a rectangular shape and covers all the nozzles of the nozzle plane therein when it contacts with the nozzle plane of the ink jet head 10. Here, it will be desirable that the height of the rib 348 is set to about 1 mm and the thickness thereof is set to about 0.7 mm. This cap 266 is made of resilient material such as rubber and it will be desirable that the hardness thereof is less than 40 degrees in A hardness of JIS (Japanese Industrial Standard).

Figure 3:
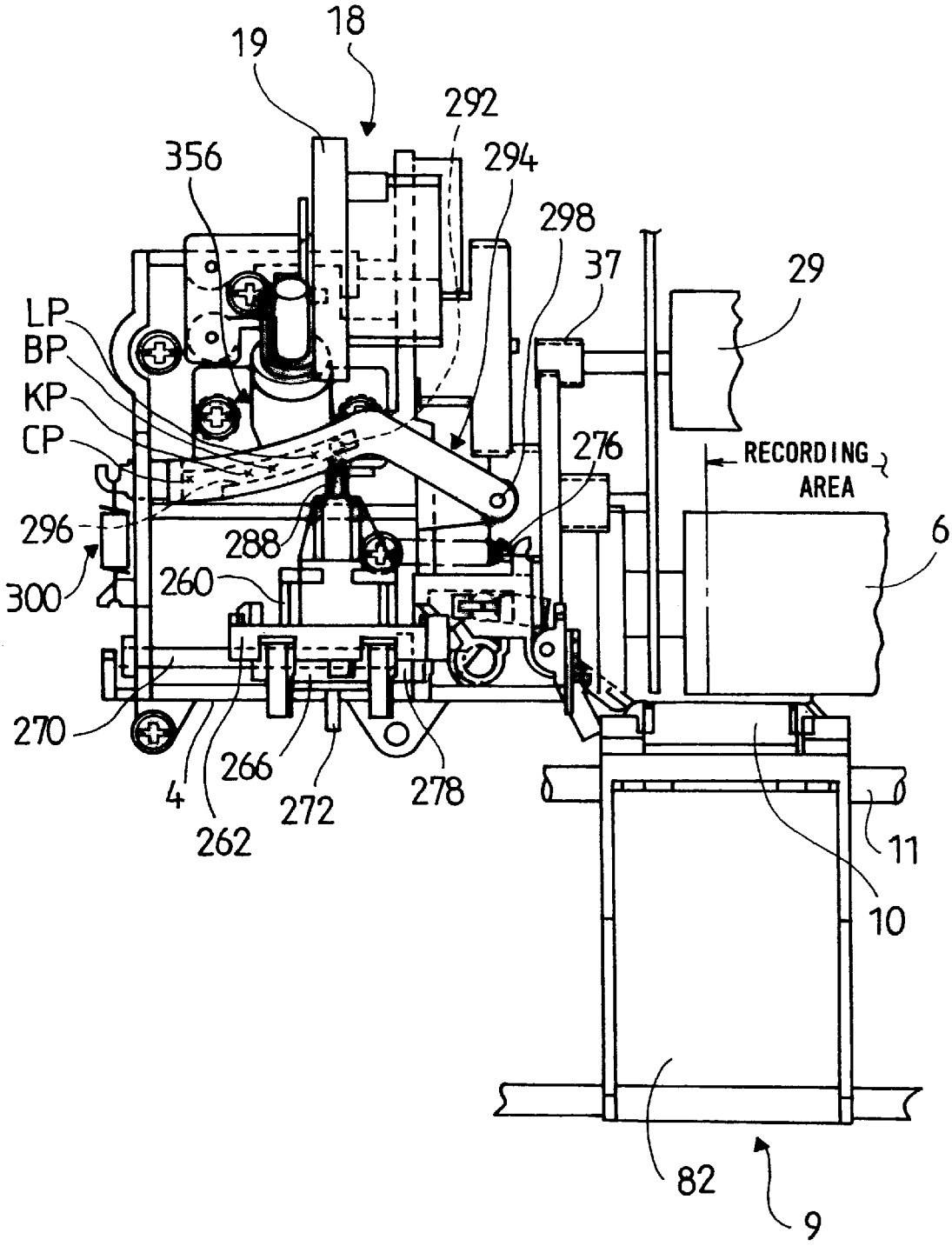
FIG. 3 is a plan view for explaining a purge device in the recovering mechanism.
Figure 7:
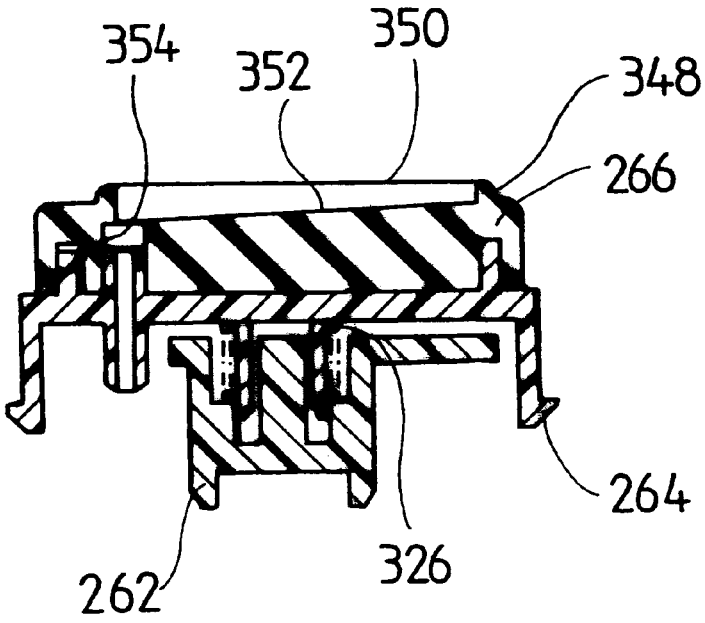
FIG. 7 is a sectional view for explaining a state where the cap is mounted on a cap holder.

As shown in FIG. 3, the cap 266 is supported on a movable table 260 through a cap holder 262 and the movable table 260 is movably inlaid in a guide rail 270 which is arranged on the sub-frame 4 parallel to the moving direction of the cap holder 262. Mounting state between both the cap 266 and the cap holder 262 is shown in FIG. 7. Between the cap 266 and the cap holder 262 a cap support member 264 is arranged. The cap 266 is held on the cap support member 264 so as not to move and a compressed coil spring 326 is inserted between the cap support member 266 and the cap holder 262.

At the center of the movable table 260 as shown in FIG. 3, an engaging projection 272 is formed at the side of the carriage 9. And between the recording area side of the moving table 260 and the sub-frame 4, it is arranged a pull coil spring 276 as a resilient member. The movable table 260 is energized to the recording area side by the pull coil spring 276. In the sub-frame 4, a stopper 278 limiting movement of the movable table 260 by the energizing force of the pull coil spring 276 is formed. Here, the position where the movable table 260 contacts with the stopper 278 is called as an original position.

At the rear side of the cap holder 262, an engaging projection 292 is formed. This engaging projection 292 is extended rearward from an inlay portion 288 of the cap holder 262 and the top thereof is figured like L-shape by being bent upward. The top of the engaging projection 292 is engaged in a rail member 294 which is mounted on the sub-frame 4. The rail member 294 has a shape shown in FIG. 3. That is, the rail member 294 is not only inclined from a support shaft 298 so as to separate from the cap holder 262 in a horizontal plane, but also inclined so as to approach to the cap holder 262, thus the rail member 294 is shaped like ⌈⟨⌋. The projection 292, which acts as a follower, is engaged in a cam groove 296 facing to underside, the cam groove 296 being formed on the inclined part of the rail member 294 which approaches to the cap holder 262.

The rail member 294 is rotatably supported around the support shaft 298 at one end thereof near the recording area, and the other end of the rail member 294 is energized in a direction that it approaches to the cap holder 262 by a pull coil spring 300 as a resilient member. Here, energizing force of the coil spring 300 is determined so as to become stronger than that of the compressed coil spring 326 which is arranged between the cap support member 264 and the cap holder 262. Further, it is formed in the sub-frame 4 a stopper (not shown) which limits movement of the rail member 294 by energizing force of the coil spring 300.

Figure 8:
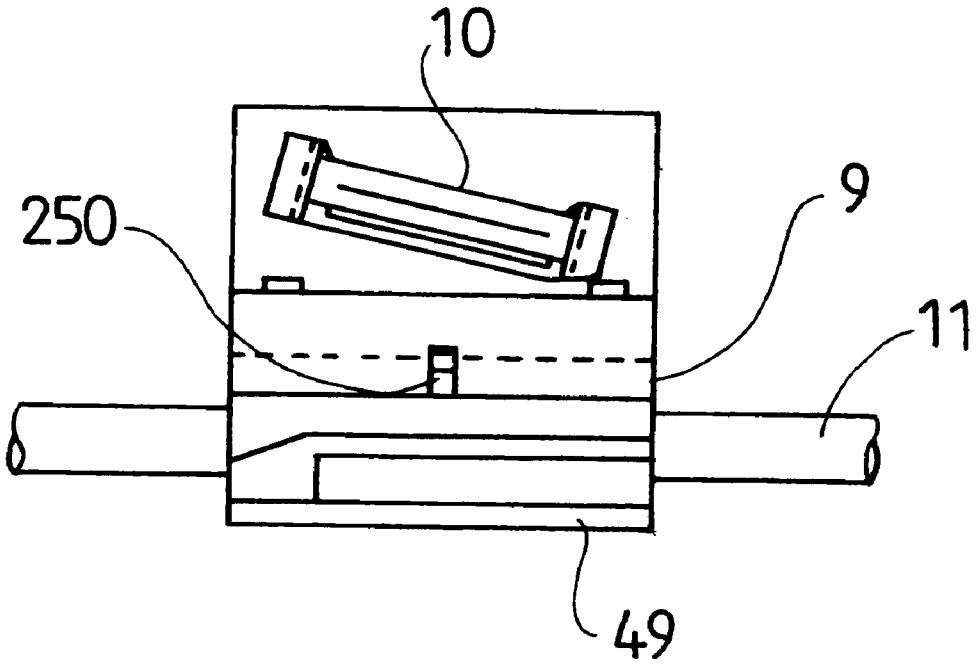
FIG. 8 is a front view of a carriage arranged in the ink jet printer.

In the center of the carriage 9, a projection 250 (see FIG. 8) which is extended toward the side of the purge device 18 (the side of the platen roller 6) is formed. Corresponding to that the carriage 9 moves to the left direction in FIG. 3, the projection 250 of the carriage 9 engages with the projection 272 of the movable table 260, thereby the movable table 260 is moved along the guide rail 270. Further, according to movement of the table 260, the projection 292 of the cap holder 262 moves along the cam groove 296 of the rail member 294, and thereby the cap holder 262 is moved forward according to the inclined cam groove 296.

As shown in FIG. 3, when the projection 292 comes to the position BP passing over the third position LP, the cap holder 262 is moved forward, thereby the top face of the rib 348 contacts with the nozzle plane of the ink jet head 10. At that time, the energizing force of the coil spring 300 overcomes the energizing force of the compressed coil spring 326, thereby the compressed coil spring 326 reduces its length. As a result, the nozzles of the ink jet head 10 are airtightly covered by the cap 266.

And when the projection 292 is further moved to the left direction, it concludes that the rail member 294 rotates around the support shaft 298 and the coil spring 300 is lengthened. According to this, the cap 266 and the ink jet head 10 are contacted with good airtightness since the energizing force of the coil spring 300 acts on the contact portion between the cap 266 and the ink jet head 10. Further, the more the projection 292 moves to the left direction, the more the coil spring 300 is lengthened, thus contact force between the cap 266 and the ink jet head 10 becomes strong. Here, elastic coefficient of the coil spring 300 and the shape of the cam groove 296 are determined so that the contact force becomes approximate 80 gf when the projection 292 is positioned at the second position KP of the cam groove 296 and becomes approximate 220 gf when the projection 292 is positioned at the first position CP of the cam groove 296.

Figure 9:
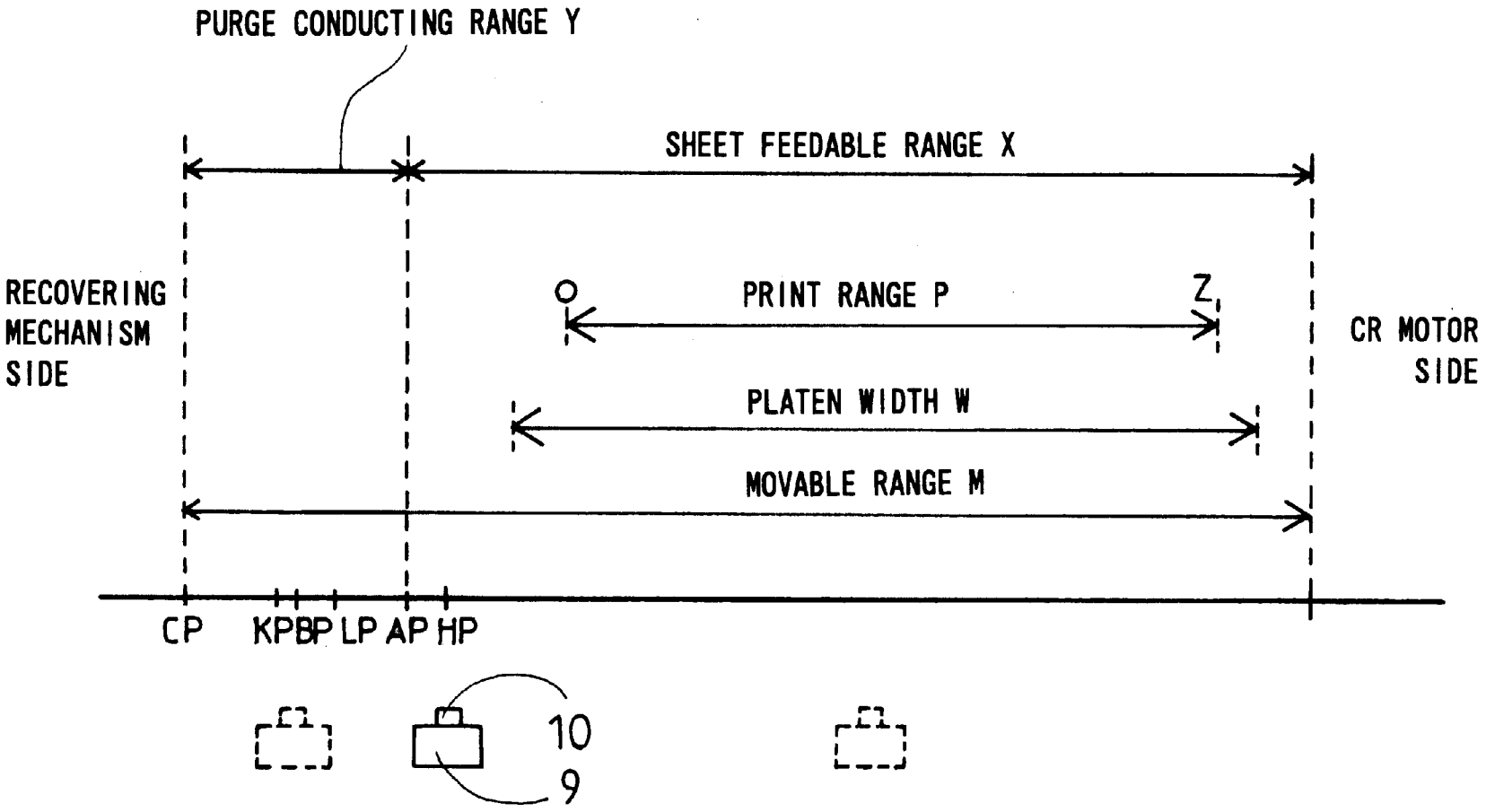
FIG. 9 is a schematic view for explaining a relation between a movable range of the carriage and the other mechanism.

Relation between the movable range of the carriage 9 and the other mechanism will be described hereinafter according to FIG. 9. In FIG. 9, the axis of abscissas represents the positions of the carriage 9, and the left direction in FIG. 3 corresponds to the left side in FIG. 2 (the side where the recovering mechanism RM exists) and the right direction in FIG. 3 corresponds to the right side in FIG. 2 (the side where the CR motor 29 exists).

The movable range M of the carriage 9 is divided into two ranges at both sides of the changeover position AP as a border, one range being the sheet feedable range X and the other range being purge conducting range Y. The changeover position AP is defined as a position where an object to which the driving force of the LF motor 29 is transmitted by movement of the carriage 9 is exchanged to the purge device 18 or the sheet feeding mechanism LM. That is, the sheet feedable range X corresponds to the range where the driving force of the LF motor 29 is transmitted to the sheet feeding mechanism LM and the purge conducting range Y corresponds to the range where the driving force of the LF motor 29 is transmitted to the purge device 18.

The sheet feedable range X is wider than the width W of the platen roller 6, and there exists the home position HP of the carriage 9 between the left end of the width W and the changeover position AP. The print sheet passes within the width W. And the print range P defined by the line head position O and the line end position Z is within the width of the print sheet, thus is within the width W of the platen roller 6. Within this print range P, the carriage 9 is moved at a predetermined printing rate.

In the purge conducting range Y, there exist the first position CP where the contact force between the cap 266 and the ink jet head 10 is held to about 220 gf, the second position KP where the contact force therebetween is held to about 80 gf and the third position LP where the cap 266 and the ink jet head 10 are slightly separated each other. At the first position CP, the second position KP and the third position LP, the first suction operation, the second suction operation and the third suction operation are conducted, respectively. Here, the second position KP is positioned slightly closer to the first position CP than the position BP where the cap 266 and the ink jet head 10 start to contact, and the third position LP is positioned between the position BP and the changeover position AP. Each of the first position CP, the second position KP, the position BP and the third position LP corresponds to the positions CP,KP, BP and LP shown in FIG. 3, respectively.

Figure 10:
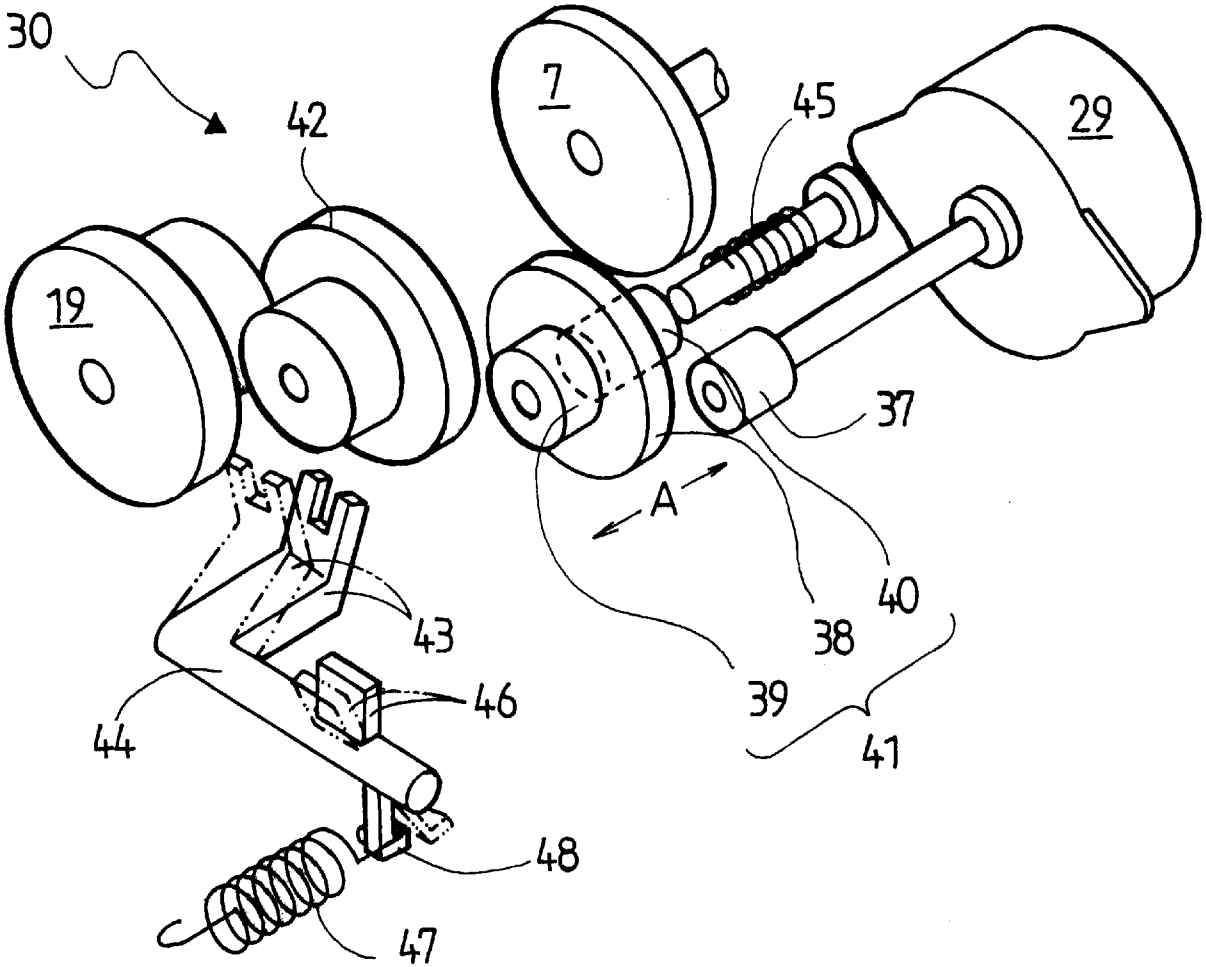
FIG. 10 is a perspective view showing a changeover mechanism arranged in the ink jet printer.

Next, construction of the changeover mechanism 30 which acts for exchanging the object to which the driving force of the LF motor 29 is transmitted to one of the purge device 18 and the sheet feeding mechanism LM, will be described hereinafter. In FIG. 10, the changeover mechanism 30 includes a LF idle gear 41 movable in an axis direction indicated by an arrow A, an idle kicker 43 moving the LF idle gear 41 in the above direction, and a compressed spring 45 energizing the LF idle gear 41 in the left direction along the arrow A. Here, in FIG. 10, though each member in the changeover mechanism 30 is separately figured for purpose of easy understanding, each member is, in fact, more closely arranged each other in the left and right directions (directions parallel to the arrow A).

The LF idle gear 41 has gear teeth 38 meshing with a motor gear 37 fixed to a drive shaft of the LF motor 29, gear teeth 40 meshing with the platen gear 7 coaxial with the platen roller 6 and gear teeth 39 meshing with a purge gear 42 which transmits the driving force to the pump cam gear 19. The gear teeth 38 and the motor gear 37 always mesh with each other. As concerned with the gear teeth 40 and the platen gear 7, the gear teeth 39 and the purge gear 42, each gear combination is selectively meshed with based on whether the LF idle gear 41 is moved in the left direction or in the right direction along the axial direction thereof.

The idle kicker 43 with a kick portion 46 and a spring hook 48 is formed on a kicker shaft 44 rotatable therearound. The idle kicker 43 is set to one position of two positions, one being indicated by the solid line and the other being indicated by the alternate long and two short dashes lines, according to rotation of the kicker shaft 44. To the spring hook 48 a pull spring 47 is hooked and the idle kicker 43, the kick portion 46 are energized toward the position indicated by the solid line by spring force of the pull spring 47. Here, the spring force produced when the pull spring 47 is shortened is stronger than the spring force produced when the compressed spring 45 is lengthened.

The kick portion 46 is formed at a position which is projected within a moving range of the carriage 9. And at the changeover position AP passed by the carriage 9 when it moves from the sheet feedable range X into the purge conducting range Y as shown in FIG. 9, a rib 49 formed on underside of the carriage 9 (see FIG. 11) kicks the kick portion 46, thereby the kick portion 46 moves to the position indicated by the alternate long and two short dashes lines. The changeover position AP can be freely set by changing length of the rib 49 of the carriage 9.

Figure 12:
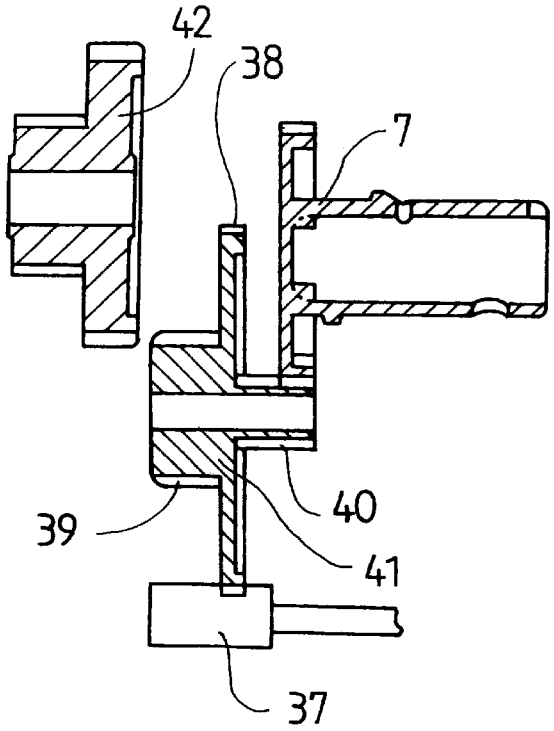
FIG. 12 is a sectional view of the changeover mechanism corresponding to a state that the carriage is positioned in the range where a print sheet is fed by the sheet feeding mechanism.

In a normal state (when the carriage 9 is positioned within the sheet feedable range X), the idle kicker 43 is held at the position indicated by the solid line by the spring force of the pull spring 47. At this time, the idle kicker 43 presses the LF idle gear 41 in the right direction along the arrow A against the energizing force of the compressed spring 45. Thus, the gear teeth 40 of the LF idle gear 41, as shown in FIG. 12, meshes with the platen gear 7, and driving force of the LF motor 29 is transmitted to the platen roller 6 and the other members. On the other hand, the gear teeth 39 does not mesh with the purge gear 42, thus the pump cam gear 19 is not driven.

Figure 13:
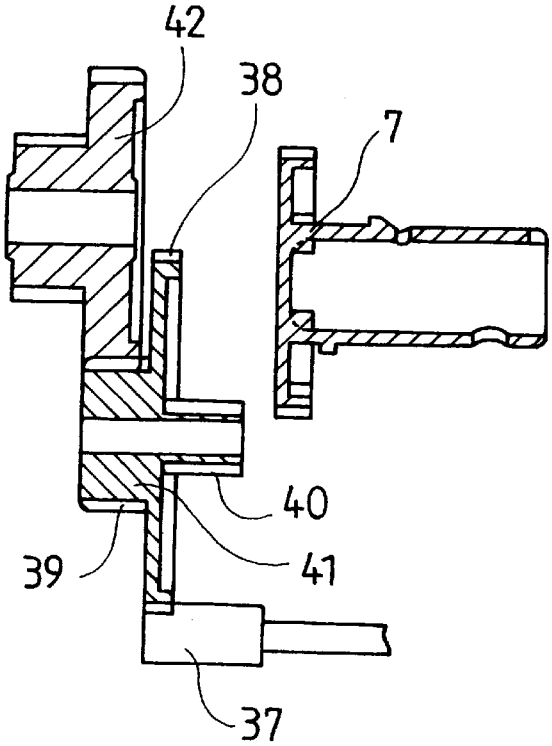
FIG. 13 is sectional view of the changeover mechanism corresponding to a state that the carriage is positioned in the range where purging operation is conducted by the purge device.

On the contrary, when the carriage 9 is positioned within the purge conducting range Y, the idle kicker 43 is positioned in a state indicated by the alternate long and two short dashes lines and is release from the energizing force of the pull spring 47. Only in this case, the LF idle gear 41 is pressed in the left direction along the arrow A by the compressed spring 45 as shown in FIG. 13, thus the gear teeth 39 meshes with the purge gear 42. In this way, driving force of the LF motor 29 is transmitted to the pump cam gear 19, therefore the purge device 18 is driven. At that time, the gear teeth 40 does not mesh with the platen gear 7, thus the platen roller 6 is not driven.

Figure 14:
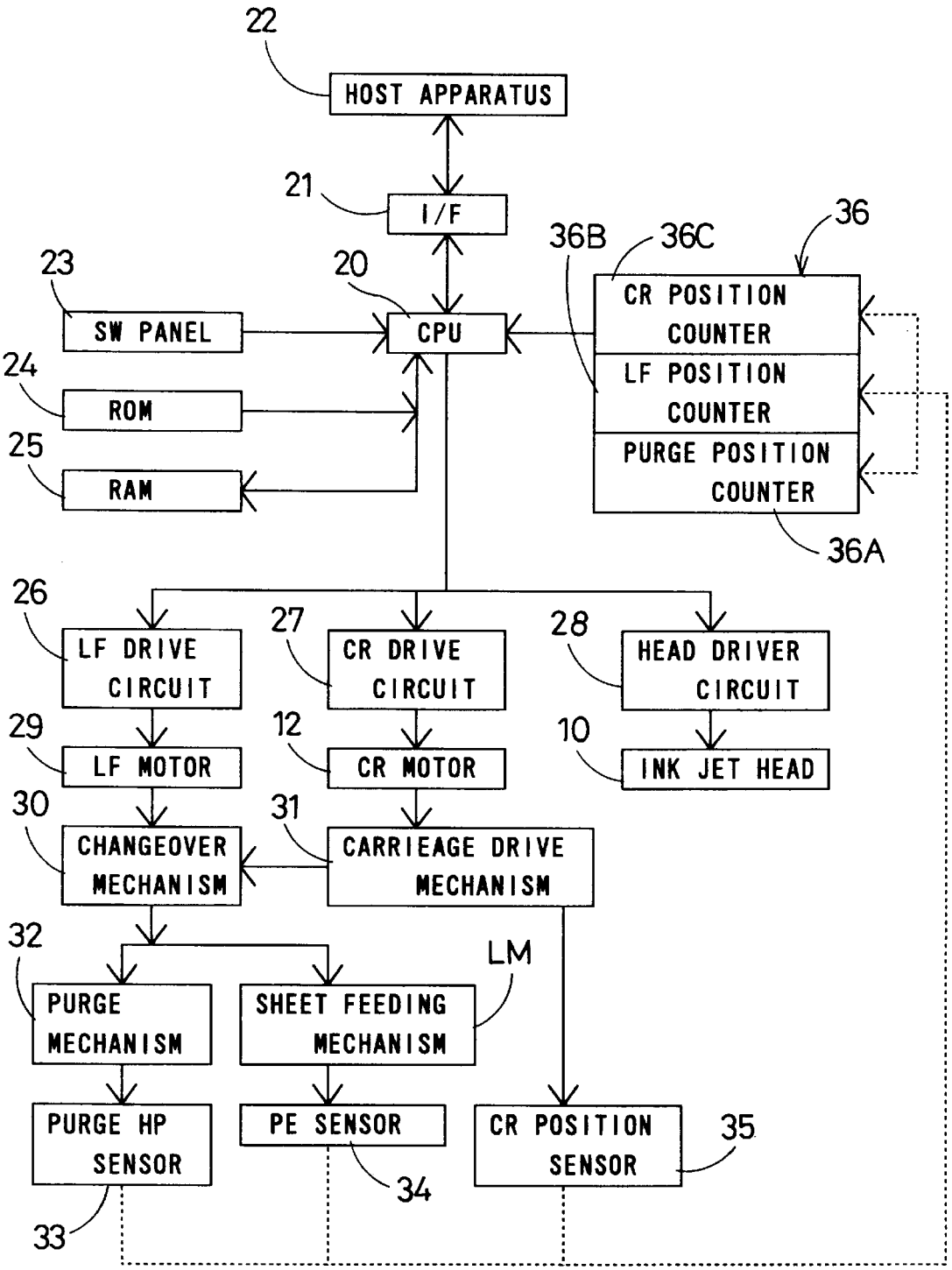
FIG. 14 is a block diagram showing a control system in the ink jet printer.

In addition to the above, control system of the ink jet printer 1 will be described according to FIG. 14. The control system is mainly constructed from CPU 20 which is a well-known central processing unit. The CPU 20 is connected to a host apparatus 22 which is, in general, a personal computer. Namely, the ink jet printer 1 receives print commands from the host apparatus 22 and conducts various printing operations according to the print commands.

To the CPU 20, a switch panel 23, ROM 24 and RAM 25 are connected. The switch panel 23 is utilized for setting various parameters such as a print sheet size and for displaying the parameters thereon. The ROM 24 stores various programs necessary for controlling the ink jet printer 1. Here, as the representative programs stored in the ROM 24, there exists suction program through which recovering of the ink jet head 10 is done by sucking the inferior ink in the ink jet head 10. The RAM 25 temporarily stores print data transmitted from the host apparatus 22 and various data necessary for controlling the ink jet printer 1.

The CPU 20 drives the LF motor 29 through a LF drive circuit 26, the CR motor 12 through a CR drive circuit 27 and the ink jet head 10 through a head drive circuit 28, respectively. The LF motor 29 selectively drives one of the purge mechanism 32 and the sheet feeding mechanism LM through the changeover mechanism 30. The purge mechanism 32 is mainly constructed from the purge device 18 and the pump cam gear 19. The sheet feeding mechanism LM is mainly constructed from the platen roller 6 and the pressure roller 8. The CR motor 12 drives the carriage drive mechanism 31. The carriage drive mechanism 31 includes the belt 13, pulleys in addition to the carriage 9. The changeover mechanism 30 is changed through movement of the carriage 9.

Each of the purge mechanism 32, the sheet feeding mechanism LM and the carriage drive mechanism 31 has a sensor from which sensor signal is transmitted to counters 36 connected to the CPU 20.

Here, a purge HP sensor 33 is arranged in the purge mechanism 32. The purge HP sensor 33 transmits to the purge position counter 36A a sensor signal indicating that the suction pump is set to the original position. This signal is used as the standard signal when the purge mechanism 32 conducts purge operation.

And a PE (paper end) sensor 34 is arrange in the sheet feeding mechanism LM. The PE sensor 34 senses the top end of the print sheet newly supplied and transmits a sensor signal to the LF position counter 36B. This signal is used as the standard signal when the print position in the vertical direction is controlled.

Further, a CR position sensor 35 is arranged in the carriage mechanism 31. The CR position sensor 35 senses the carriage position by counting drive pulses of the CR motor 12 and transmits a sensor signal to the CR position counter 36C. This signal is used as the standard signal when the print position in the horizontal direction is controlled. Further, such signal is used when it is judged whether sheet supply operation of the new print sheet can be done or not and discharge operation of the printed sheet can be done or not.

Next, operation of the ink jet printer 1 will be described hereinafter. At first, the print sheet is fed from the manual sheet supply part 3 or the sheet supply cassette 5 into the ink jet printer 1, as shown in FIG. 1, and the print sheet is fed to the platen roller 6. On the other hand, the carriage 9 mounting the ink jet head 10 thereon is driven by the CR motor 12. At that time, when the carriage 9 is positioned within the print range P included in the sheet feedable range X shown in FIG. 9, the ink jet head 10 ejects ink droplets form the nozzles and prints images such as characters onto the print sheet according to the print data transmitted from the host apparatus 22 (see FIG. 14).

After the ink jet head 10 conducts predetermined printing amount of images, wiping operation of the nozzle plane of the ink jet head 10 is done by the wiping device 15. Here, such wiping operation may be conducted before printing amount reaches to the predetermined amount, corresponding to an extent that the nozzle plane of the ink jet head 10 becomes dirty by the ink and the like.

Figure 11:
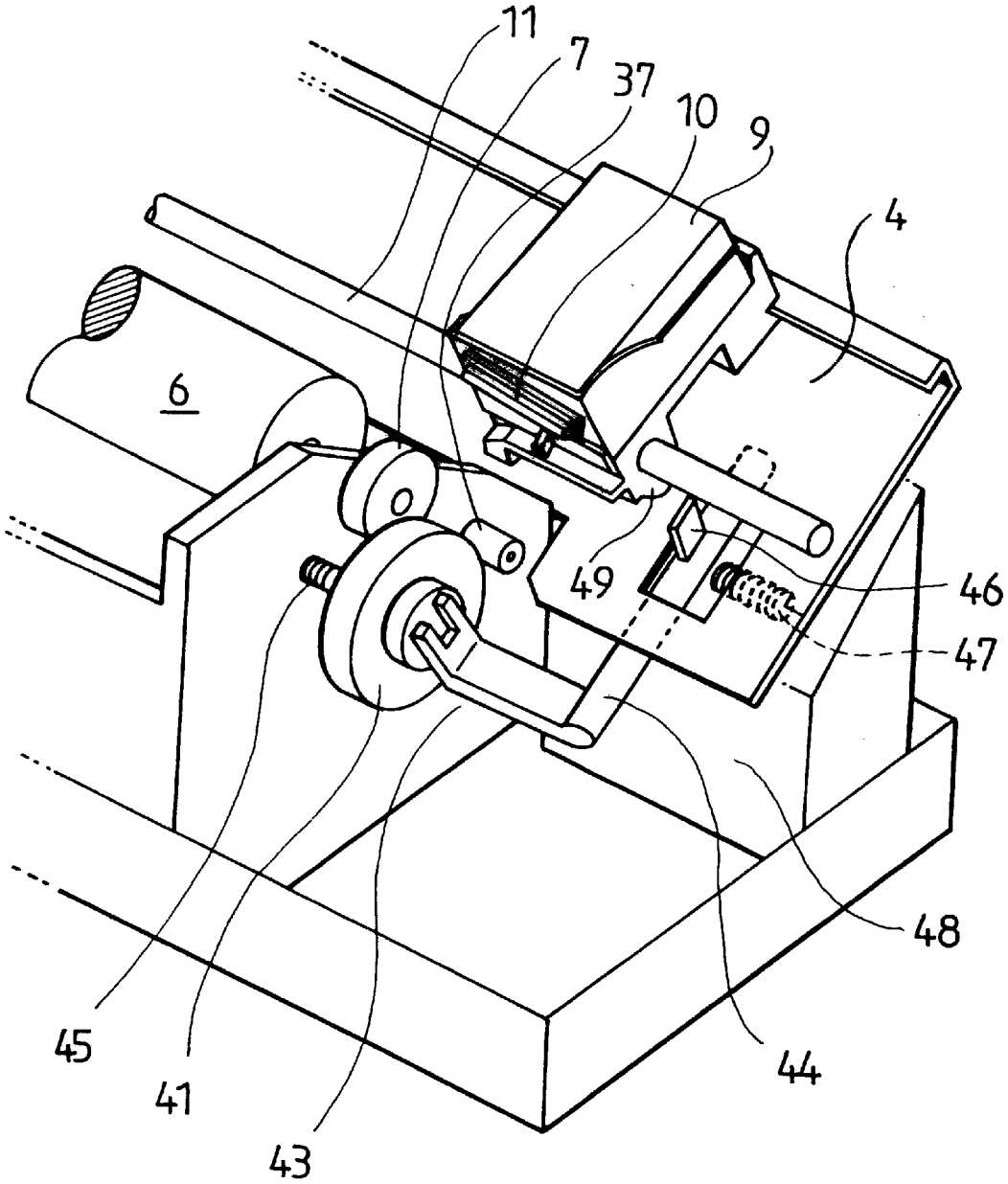
FIG. 11 is a perspective view showing a peripheral mechanism around the changeover mechanism.

Recovering operation of the ink jet head 10, that is, suction operation is conducted with predetermined frequency, and may be selectively conducted when the operator (user) judges that it is necessary to recover the ink jet head 10. At this time, print operation is stopped and the carriage 9 is moved to the purge conducting range Y from the sheet feedable range X as shown in FIG. 9. Thus, when the carriage 9 exceeds the changeover position AP, the rib 49 of the carriage 9 kicks the kick portion 46 of the idle kicker 43 in the changeover mechanism 30, as shown in FIG. 11. Therefore, the object meshing with the LF idle gear 41 is changed to the purge gear 42 from the platen gear 7 and drive force of the LF motor 29 is transmitted to the purge device 18. Further, the projection 250 of the carriage 9 is engaged with the projection of the movable table 260 on the basis of movement of the carriage 9, thus the movable table 260 is moved along the guide rail 270 (see FIG. 3).

In order to conduct the first suction operation, the carriage 9 is moved so that the projection 292 comes to the first position CP in the cam groove 296 and the carriage 9 is stopped there. Therefore, the rib 348 of the cap 266 is contacted with the ink jet head 10 and the nozzles are covered by the cap 266. At that time, the cap 266 is pressed to the ink jet head 10 with the contact force of about 220 gf by the energizing force of the coil spring 300.

When the LF motor 29 is driven and the suction pump 356 is operated, the negative pressure produced by the suction pump 356 is added to the space A formed between the cap 266 and the ink jet head 10 through the hole 354 in the cap 266. At that time, air cannot be introduced into the space A through the contact portion between the cap 266 and the ink jet head 10 since the contact force therebetween is strong. Thus, the inferior ink in the ink jet head 10 is sucked through the nozzles thereof. Further, foreign substance adhered near the nozzles is also torn off. At the same time, the ink is newly supplied into the ink jet head 10 from the ink cartridge 82. After predetermined amount of the ink is sucked from the ink jet head 10, the suction pump 356 is stopped and addition of the negative pressure is released. Here, the predetermined amount of the ink means the amount necessary to satisfactorily fill up the ink jet head 10.

Figure 15:
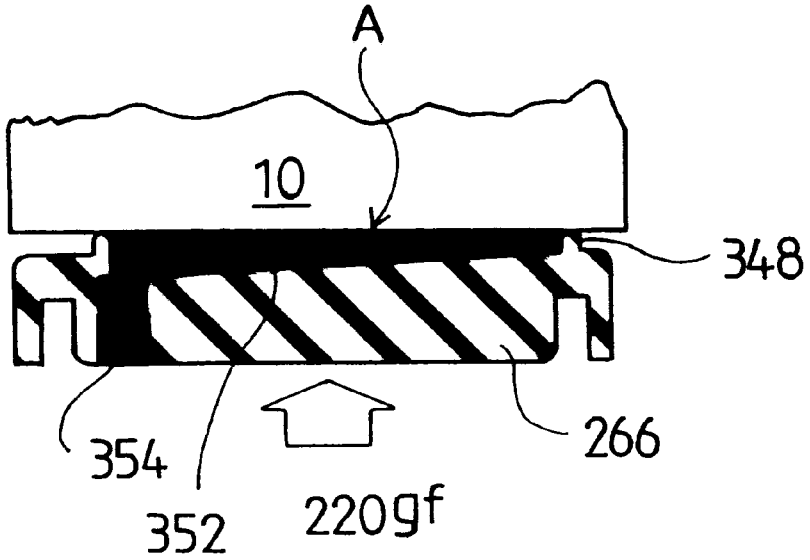
FIG. 15 is a sectional view showing a state that the cap is filled up therein by the ink sucked from the ink jet head through the first suction operation.

At that time, as shown in FIG. 15, the space A is filled up with the ink sucked from the ink jet head 10. And a part of the sucked ink is sent to the drain tank through the hole 354, the suction pump 356 and is absorbed in the ink absorbing member installed in the drain tank. The above operation is the first suction operation.

Next, in order to conduct the second suction operation, the carriage 9 is moved so that the projection 292 comes to the second position KP in the cam groove 296 and the carriage 9 is stopped there. Therefore, the rib 348 of the cap 266 is still contacted with the ink jet head 10 and the nozzles are covered by the cap 266. However, at that time, the cap 266 is pressed to the ink jet head 10 with the contact force of about 80 gf. In this way, the contact force is reduced to 80 gf from 220 gf.

Figure 16:
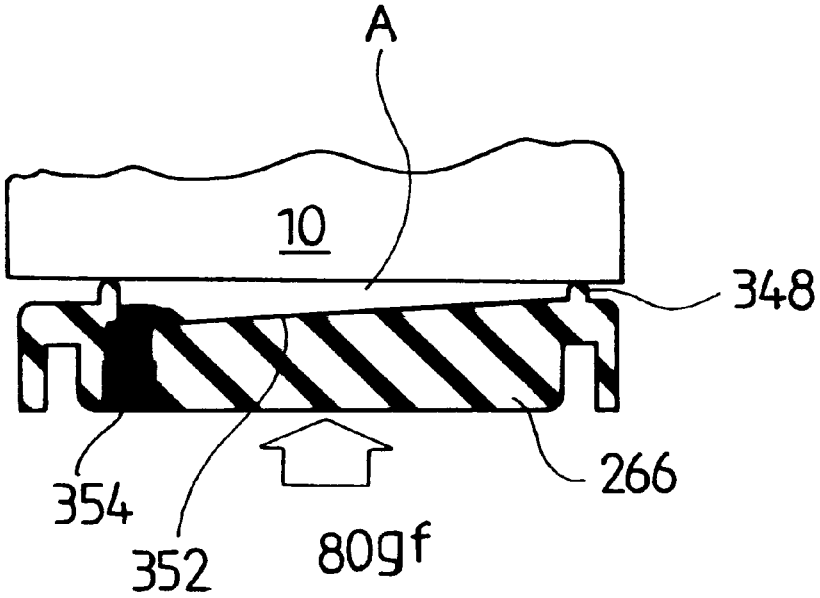
FIG. 16 is a sectional view showing a state that the ink is removed from the cap through the second suction operation.

When the LF motor 29 is driven and the suction pump 356 is operated, the negative pressure produced by the suction pump 356 is added to the space A formed between the cap 266 and the ink jet head 10 through the hole 354 in the cap 266. At that time, the contact force is weakened as mentioned above. Therefore, the the rib 348 of the cap 266 is easily deformed by the negative pressure and the space A communicates with the atmosphere because the contact state between the cap 266 and the ink jet head 10 is partially broken. As a result, the ink filled in the space A is sucked through the hole 354 without the ink being furthermore sucked from the ink jet head 10. Thereafter, as shown in FIG. 16, the space A is filled up with air supplied from the atmosphere. The ink sucked through the hole 354 is sent to the drain tank via the suction pump 356 and is absorbed in the ink absorbing member installed in the drain tank. The above operation is the second suction operation.

Here, after the first suction operation the suction pump 356 is stopped and thereafter the negative pressure is again added by operating the suction pump 356 after the carriage 9 is moved to the second position KP . The reason is as follows. That is, the negative pressure is added not only to the space A but also in the ink jet head 10 after the first suction operation. Thus, in case that the contact force between the cap 266 and the ink jet head 10 is reduced while the above state is retained, air from the atmosphere is introduced into the ink jet head 10 to which the negative pressure is added, through the nozzles, as a result, the ink jetting condition of the ink jet head 10 instead becomes bad.

Figure 17:
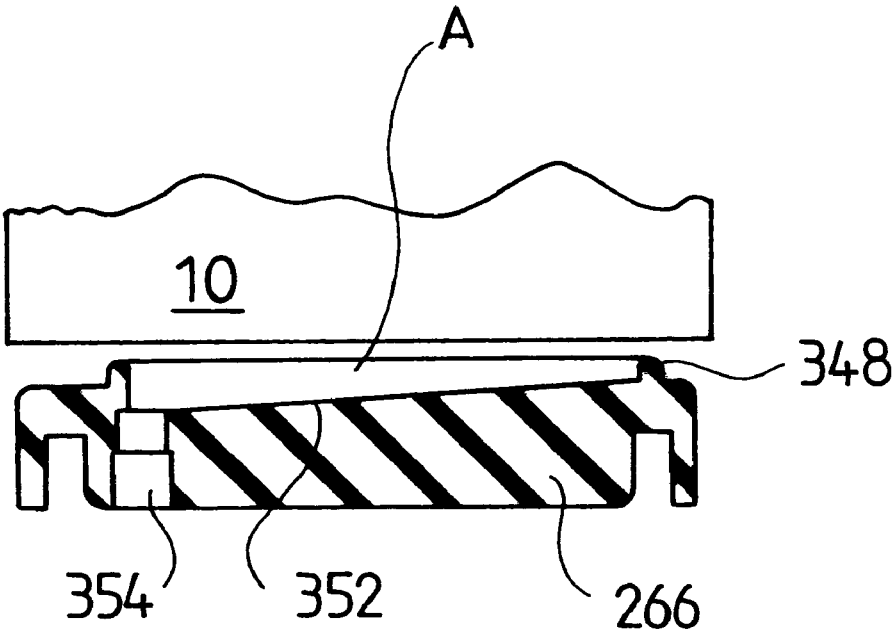
FIG. 17 is a sectional view showing a state that the third suction operation is conducted.

Next, in order to conduct the third suction operation, the carriage 9 is moved so that the projection 292 comes to the third position LP in the cam groove 296 and the carriage 9 is stopped there. Therefore, as shown in FIG. 17, the rib 348 of the cap 266 is slightly separated from the ink jet head 10 and air from the atmosphere is supplied between the cap 266 and the ink jet head 10. Further, since the hole 354 is formed on the deepest position to which the bottom plane 352 of the cap 266 is inclined, the ink left in the cap 266 is completely sucked and removed therefrom. Further, the ink left in the suction pump 356 and in the hose connecting both the suction pump 356 and the cap 266 is sucked and removed. Thereafter, the suction pump 356 is stopped. The above operation is the third suction operation.

Here, during the second suction operation the negative pressure by the suction pump 356 is not added in the ink jet head 10, thus there will be no problem if the carriage 9 is moved to the third position LP while operating the suction pump 35. Of course, it may be able to move the carriage 9 after the suction pump 356 is stopped. Further, if the ink in the cap 266 and in the suction pump 356 can be completely sucked and removed only by the second suction operation, it may omit the third suction operation.

According to the above, when the ink jet head 10 is recovered in good ink jetting condition by filling up the ink jet head 10 with the fresh ink by removing the inferior ink therefrom, the carriage 9 is moved from the purge conducting range Y to the sheet feedable range X and printing operation is again started. Here, also in case that the empty ink cartridge 82 is exchanged with the new one, the suction operation similar to the above is conducted and the ink jet head 10 is filled up the ink.

In the above constructed ink jet printer 1, the suction pump 356 corresponds to suction means, the coil spring 300 corresponds to pressing means, the rail member 294 with the cam groove 296 corresponds to control means, and the pressing force in the first stage is realized at the first position CP in the cam groove 296, the pressing force in the second stage is realized at the second position KP in the cam groove 296.

As mentioned above in detail, in the ink jet printer 1 according to the embodiment, when the carriage 9 is positioned within the purge conducting range Y, the drive force of the LF motor 29 is transmitted to the purge device 18 through the changeover mechanism 30. Therefore, based on that the suction pump 356 in the purge device 18 is driven by the LF motor 29, the inferior ink in the ink jet head 10 is sucked and removed therefrom, thereby the ink jetting condition of the ink jet head 10 can be recovered.

Here, since the first suction operation is conducted while the cap 266 and the ink jet head 10 are strongly contacted with each other by moving the carriage 9 to the first position CP, the inferior ink in the ink jet head 10 can be sucked into the cap 266. Further, since the second suction operation is conducted while the contact force between the cap 266 and the ink jet head 10 is weakened by moving the carriage 9 to the second position KP, the contact state between the cap 266 and the ink jet head 10 is partially broken and air from the atmosphere is introduced. Therefore, the ink stored in the cap 266 can be discharged into the drain tank without leaking such ink out of the cap 266. Further, since the third suction operation is conducted while the cap 266 and the ink jet head 10 are mutually separated by moving the carriage 9 to the third position LP, the ink in the cap 266 and in the suction pump 356 can be completely sucked and removed therefrom.

In this way, it can realize the excellent ink jet printer 1 that not only the ink jetting condition of the ink jet head 10 can be recovered by sucking the inferior ink therein, but also the sucked ink can be certainly discharged without soiling the print sheet and the other mechanism in the printer 1 by the sucked ink.

While the invention has been particularly shown and described with reference to preferred embodiments thereof, it will be understood by those skilled in the art that the foregoing and other changes in form and details can be made therein without departing from the spirit and scope of the invention. For example, in the above ink jet printer 1, various concrete numerical values such as the hardness of the material of the cap 266, the shape, the height and the width of the rib 348, the contact force between the cap 266 and the ink jet head 10 while the suction operations are merely raised as examples. Therefore, the present invention is, of course, not limited to the above numerical values.

What is claimed is:

1. An ink jet recording apparatus including an inkjet head for ejecting ink droplets from nozzles onto a recording medium, a cap made of deformable material for covering the ink jet head and suction means for sucking the ink to recover ink jetting condition of the ink jet head by adding a negative pressure to the cap, the ink jet recording apparatus comprising:

pressing means for contacting the cap with the ink jet head; and control means for controlling a contact force by the pressing means, through which the cap is contacted with the ink jet head, the control means controlling the contact during at least two continuous positions, the at least two continuous positions including a first position and a second position occurring after the first position;

wherein the contact force corresponding to the first position has a first strength that the cap is isolated from atmosphere when the negative pressure is added to the cap by the suction means; and wherein the contact force corresponding to the second position has a second strength different from the first strength such that the cap is partially deformed and communicated with atmosphere when the negative pressure is added to the cap by the suction means.

2. The ink jet recording apparatus according to claim 1, wherein the suction means conducts a first suction operation when the cap is contacted with the ink jet head by the contact force corresponding to the first position and conducts a second suction operation when the cap is contacted with the ink jet head by the contact force corresponding to the second position.

3. The ink jet recording apparatus according to claim 2, wherein the suction means conducts a third suction operation when the cap is separated from the ink jet head.

4. The ink jet recording apparatus according to claim 3, wherein the third suction operation occurs after the second suction operation.

5. The ink jet recording apparatus according to claim 2, further comprising a carriage mounting the ink jet head thereon, the carriage moving within a carriage moving range.

6. The ink jet recording apparatus according to claim 5, wherein the carriage moving range includes a suction operating range.

7. The ink jet recording apparatus according to claim 6, further comprising a hold member for holding the cap which moves within the suction operating range according to movement of the carriage, wherein the control means controls the contact force by the pressing means based on movement of the hold member.

8. The ink jet recording apparatus according to claim 7, wherein the control means comprises a follower formed in the hold member and a rotatable rail member having a cam groove in which the follower is put so as to move therealong, and wherein the rail member is rotated when the follower moves along the cam groove according to the movement of the hold member.

9. The ink jet recording apparatus according to claim 8, wherein the follower is a projection formed in the hold member.

10. The ink jet recording apparatus according to claim 8, wherein the pressing means includes a first spring for energizing the rail member in a predetermined direction and a second spring arranged between the cap and the hold member.

11. The ink jet recording apparatus according to claim 10, wherein the contact force is determined by a relationship between a first spring force of the first spring and a second spring force of the second spring.

12. The ink jet recording apparatus according to claim 11, wherein the first spring force of the first spring is stronger than the second spring force of the second spring.

13. The ink jet recording apparatus according to claim 8, wherein the cam groove has at least a first cam groove position and a second cam groove position, and the first suction operation is conducted when the follower is moved to the first cam groove position and the second suction operation is conducted when the follower is moved to the second cam groove position.

14. The ink jet recording apparatus according to claim 13, wherein the contact force of the first position is produced when the follower is moved to the first cam groove position and the contact force of the second position is produced when the follower is moved to the second cam groove position.

15. The ink jet recording apparatus according to claim 14, wherein the contact force of the first position is set stronger than the contact force of the second position.

16. The ink jet recording apparatus according to claim 15, wherein the contact force of the first position is set to approximate 220 gram-foce and the contact force of the second position is set to approximate 80 gram-foce.

17. The ink jet recording apparatus according to 7, further comprising a sheet feed mechanism for feeding the print medium to a platen roller, a suction operating mechanism for operating the suction means, a drive motor for selectively driving one of the sheet feed mechanism and the suction operating mechanism and a changeover mechanism for selectively connecting the drive motor to one of the sheet feed mechanism and the suction operating mechanism based on the movement of the carriage.

18. The ink jet recording apparatus according to claim 17, wherein the changeover mechanism conducts switching operation so as to connect the drive motor to the suction operating mechanism when the carriage is moved within the suction operating range.

19. The ink jet recording apparatus according to claim 1, wherein the cap has a rib forming a space between the ink jet head when the cap is contacted with the ink jet head and the negative pressure is added to the space.

20. The ink jet recording apparatus according to claim 19, wherein the cap has a rectangular shape so as to cover all of the nozzles within the space.

21. The ink jet recording apparatus according to claim 20, wherein the cap is made of resilient material.

22. The ink jet recording apparatus according to claim 19, wherein the resilient material is rubber.

23. An ink jet recording apparatus including an ink jet head for ejecting ink droplets from nozzles onto a recording medium, a cap made of deformable material for covering the ink jet head and suction means for sucking the ink to recover ink jetting condition of the ink jet head by adding a negative pressure to the cap, the ink jet recording apparatus comprising:

pressing means for contacting the cap with the ink jet head by at least two kinds of contact forces including a first contact force and a second contact force;

wherein the cap is contacted with the ink jet head while isolating from atmosphere under the first contact force when the negative pressure is added to the cap by the suction means; and wherein the cap is contacted with the ink jet head while the cap is partially deformed and communicated with atmosphere under the second contract force when the negative pressure is added to the cap by the suction means.

* * * * *